US007284285B2

(12) United States Patent
Scalzi

(10) Patent No.: US 7,284,285 B2
(45) Date of Patent: Oct. 23, 2007

(54) TOILET AND BIDET SYSTEM

(76) Inventor: Saverio Scalzi, 4801 Buchanan St., Hollywood, FL (US) 33021

( * ) Notice: Subject to any disclaimer, the term of this patent is extended or adjusted under 35 U.S.C. 154(b) by 180 days.

(21) Appl. No.: 11/047,929

(22) Filed: Feb. 1, 2005

(65) Prior Publication Data

US 2007/0204395 A1 Sep. 6, 2007

(51) Int. Cl.

| | |
|---|---|
| ***A47K 3/20*** | (2006.01) |
| ***A47K 4/00*** | (2006.01) |
| ***E03D 9/08*** | (2006.01) |
| ***E03D 9/04*** | (2006.01) |

(52) U.S. Cl. ..... 4/420.1; 4/213

(58) Field of Classification Search ..... 4/420.1–420.5, 4/213

See application file for complete search history.

(56) References Cited

U.S. PATENT DOCUMENTS

| | | | | |
|---|---|---|---|---|
| 1,014,787 | A | 1/1912 | Torossian | |
| 1,990,578 | A | 2/1935 | Zorraquin | |
| 2,762,058 | A | 9/1956 | Hurko | |
| 3,845,509 | A | 11/1974 | Lieber | |
| 3,979,781 | A | 9/1976 | Jolicoeur | |
| 4,370,764 | A | 2/1983 | Ando et al. | |
| 4,389,738 | A | 6/1983 | Ando et al. | |
| 4,551,867 | A | 11/1985 | Gurevich et al. | |
| 4,558,473 | A | 12/1985 | Morikawa et al. | |
| 4,628,548 | A | 12/1986 | Kurosawa et al. | |
| 4,653,126 | A | 3/1987 | Morandi et al. | |
| 5,003,645 | A | 4/1991 | Alonso | |
| 5,097,539 | A | 3/1992 | Tchorbadjian | |
| 5,495,625 | A | 3/1996 | McGuire | |
| 5,884,345 | A | 3/1999 | Sugiyama et al. | |
| 6,000,070 | A | 12/1999 | Bonin | |
| 6,073,275 | A * | 6/2000 | Klopocinski | 4/420.4 |
| 6,516,475 | B1 * | 2/2003 | Anderson | 4/420.4 |

* cited by examiner

*Primary Examiner*—Tuan Nguyen
(74) *Attorney, Agent, or Firm*—David P. Lhota, Esq.; Stearns Weaver Miller Weissler Alhadeff & Sitterson, P.A.

(57) ABSTRACT

A combined toilet and bidet system that may be manufactured with a toilet or mounted and adapted to the design of an existing toilet comprising a first adjustable nozzle mountable near the front end of a toilet bowl, second adjustable nozzle mountable near the back end of the toilet bowl, faucet/valve system for receiving and controllably combining multiple water sources in a manner that controls the temperature of water outputted, conduit for delivering water from the selected water source(s) to the faucet/valve system, conduit for delivering water from the faucet/valve system to a splitter that outputs the water received to the nozzles, conduit for delivering the water from the splitter to the first and second nozzles, at least one directional control system for controllably adjusting the angle of at least one of and preferably all of the nozzles to dictate the direction(s) water is ejected therefrom and exhaust system for removing odors from the area of the toilet-bidet system.

9 Claims, 4 Drawing Sheets

TOILET AND BIDET SYSTEM

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a toilet and bidet device, and, more particularly to a toilet having a built-in bidet with multiple nozzles, adjustable water temperatures, exhaust system and controls.

2. Description of the Background Art

Toilets and bidets are known in the art. Conventional toilets and bidets comprise separate units, necessitating the availability of additional space in a bathroom, or complicated designs that are not practical for mass production or use. Many, if not most, bathrooms are too small to accommodate both a toilet and bidet. Portable bidet-like washing devices have been made available for attaching to an existing toilet, but they are typically complicated in design, unreliable or incompatible with existing toilets. Accordingly, if there existed a toilet and bidet system that facilitated simultaneous use with existing or newly manufactured toilets, as disclosed by the instant invention, it would be well received.

Various toilet and bidet systems are known in the background art. However, the devices known fail to adequately address and resolve the shortcomings noted in the prior art. For instance, U.S. Pat. No. 6,516,475, issued to Anderson, discloses a toilet device which allows a person in a wheelchair to slide from the wheelchair directly onto the toilet. U.S. Pat. No. 3,979,781, issued to Jolicoeur, discloses a nozzle attachment for a toilet bowl for spraying cleaning water on toilet paper. U.S. Pat. No. 3,845,509, issued to Lieber, discloses a bidet-commode constructed for directing a jet of water to clean desired areas of the body, which is adjustable in temperature and pressure. U.S. Pat. No. 2,762,058, issued to Hurko, discloses a sanitary fixture having a nozzle positioned to discharge a stream of water forwardly on the closet bowl and between the buttocks of the person using the bowl. U.S. Pat. No. 4,558,473, issued to Morikawa et al., discloses sanitary cleaning equipment having a flushing portion adapted to direct a jet of cleaning water against a selected area, deodorizing portion having a tunnel with a deodorant and dryer portion having a second wind tunnel. U.S. Pat. No. 4,370,764, issued to Ando et al., discloses a topical washing device having a washing nozzle for discharging washing water, water feed line connecting the washing nozzle to a source of water and heat exchanger for controlling the temperature of the water. U.S. Pat. No. 4,389,738, issued to Ando et al., discloses a body part cleansing device for use with a toilet that provides a jet of warm water which has been mixed with air. U.S. Pat. No. 4,551,867, issued to Gurevich et al., discloses a toilet bowl unit having a water supply element located in the interior of the bowl in the front region and arranged to wash the lower part of a user's body. U.S. Pat. No. 4,628,548, issued to Kurosawa et al., discloses a device and method for moving a cleansing nozzle connected to a water supply system. U.S. Pat. No. 4,653,126, issued to Morandi et al., discloses a hot water spray for washing and hot air blower for drying. U.S. Pat. No. 5,003,645, issued to Alonso, discloses a bidet assembly removably mounted to the rear flange member of conventional toilets. U.S. Pat. No. 5,097,539, issued to Tchorbadjian, discloses a hygienic spray apparatus for use in connection with a toilet bowl. U.S. Pat. No. 5,495,625, issued to McGuire, discloses a toilet bowel bidet attachment having a water supply assembly coupable to hot and cold water supply lines and positionable in adjacency relative to a toilet. U.S. Pat. No. 5,884,345, issued to Sugiyama et al., discloses a sanitary device having a first nozzle positioned within the toilet bowl and main passage and auxiliary passage. U.S. Pat. No. 6,000,070, issued to Bonin, discloses a toilet and bidet combination providing a traditional toilet bowl and bidet in one unit wherein heated air is forced into the bowl and water is directed into the bowl under pressure for flushing and operating the bidet. U.S. Pat. No. 1,990,578, issued to Zorraquin, discloses a domestic sanitary appliance having a lengthened basin divided into two sections. U.S. Pat. No. 1,014,787, issued to Torossian, discloses a water closet having a spraying means for ablution and under the control of the user and wholly independent of the flushing devices for flushing the bowl of the water closet.

Although various toilet and bidet systems are disclosed by the background art, they fail to adequately address the above-noted issues. The instant invention addresses the foregoing gaps and needs in the prior art as contemplated by the instant invention disclosed herein.

BRIEF SUMMARY OF THE INVENTION

In light of the foregoing, a primary object of the present invention is to provide a bidet accessory system.

It is an object of the instant invention to provide a combined toilet and bidet system.

It is another object of the instant invention to provide a combined toilet and bidet system that is adaptable for exhausting odors.

It is an additional object of the instant invention to provide a combined toilet and bidet system that is simple in construction and conducive for low-cost mass production.

It is also an object of the instant invention to provide a combined toilet and bidet system that operates off of existing water.

It is another object of the instant invention to provide a combined toilet and bidet system that provides temperature control of the water.

It is a further object of the instant invention to provide a combined toilet and bidet system that provides adjustable control of the water force.

It is yet another object of the instant invention to provide a combined toilet and bidet system that provides adjustable control of the direction water is ejected.

It is yet a further object of the instant invention to provide a combined toilet and bidet system that replaces an existing toilet without structurally altering the bathroom wherein it fits in the same spot as the existing toilet being replaced.

In light of these and other objects, the instant invention provides a combined toilet and bidet system that may be manufactured with a toilet or mounted and adapted to the design of an existing toilet. The instant invention is designed to replace an existing toilet that fits in the same spot as the toilet being replaced without structurally altering the bathroom. The combined toilet-bidet system of the instant invention preferably comprises a first adjustable nozzle mountable near the front end of a toilet bowl, second adjustable nozzle mountable near the back end of the toilet bowl, faucet/valve system for receiving and controllably combining multiple water sources in a manner that controls the temperature of water outputted, conduit for delivering water from the selected water source(s) to the faucet/valve system, conduit for delivering water from the faucet/valve system to a splitter that outputs the water received to the nozzles, conduit for delivering the water from the splitter to the first and second nozzles, at least one directional control system for controllably adjusting the angle of at least one of and preferably all of the nozzles to dictate the direction(s) water is ejected therefrom and adapter for connecting any exhaust system that removes odors from the area of the toilet-bidet system. The faucet/valve system receives and controls the mixture and relative concentration of the received cold and hot water supplies to set the desired temperature of the water supplied to and ejected from the nozzles. The toilet-bidet system may also include controls for flushing a toilet by controlling the release lever or plunger in the toilet's main water tank used for flushing water from the toilet. The instant invention may also include at least one channel integrally built into the toilet or mountable to an existing toilet bowl for concealing and routing conduit used in the instant invention, such as conduit from the hot and cold water supplies to the faucet/valve system, conduit between the faucet/valve system and splitter and, or conduit between the splitter and nozzles, and, or other control mechanisms, such as a manually operated toilet flushing release lever/string/cable or an electric solenoid powered through low voltage wiring that pulls the flushing release lever/string/cable to electrically open and close the plunger/valve.

The control system is preferably stored in and accessible from a control panel positioned or mountable at or proximal the front end of the toilet. The control panel preferably includes a water-tight seal that insulates it and its corresponding electronic circuitry from water and moisture. The exhaust system preferably comprises an adapter for attaching exhaust conduit tied to an exhaust fan. The valves and, or control panel may comprise electronic, mechanical or fluid actuated controls.

In accordance with these and other objects, which will become apparent hereinafter, the instant invention will now be described with particular reference to the accompanying drawings.

DETAILED DESCRIPTION OF THE INVENTION

Figure 7:
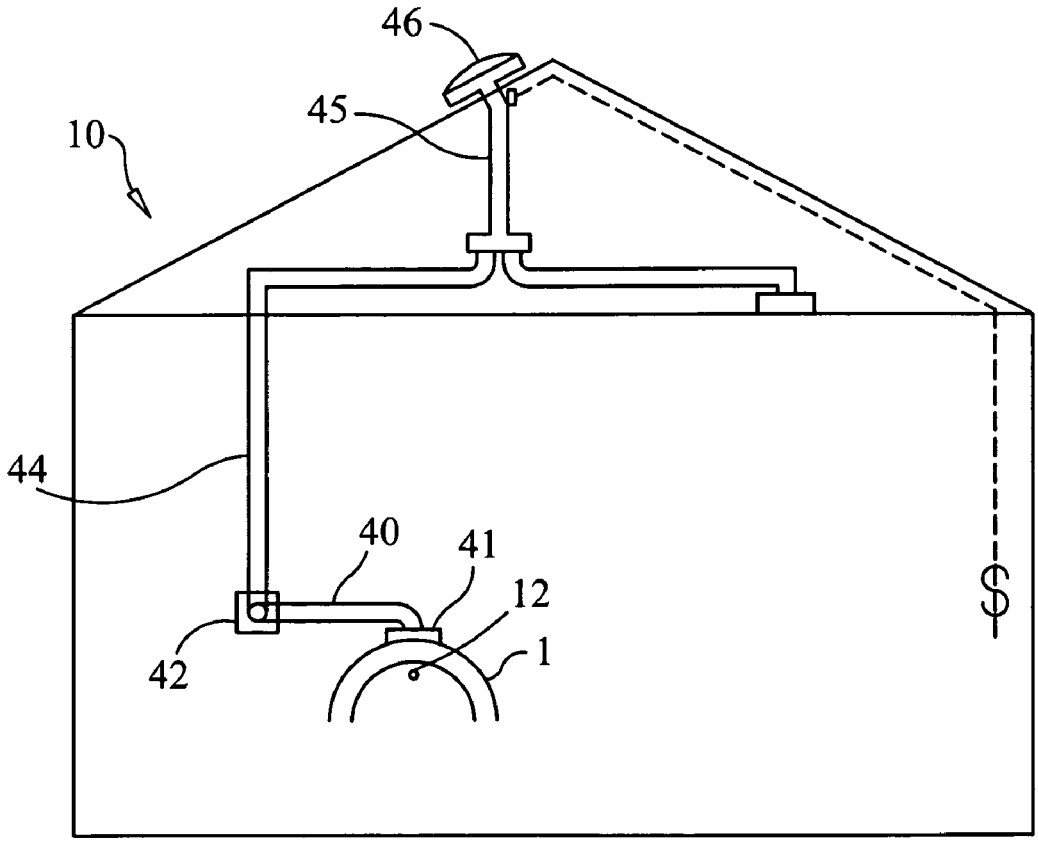
FIG. 7 is a system diagram view of the preferred embodiment of the toilet-bidet system connected to an exhaust system in accordance with the instant invention.

With reference to the drawings, FIGS. 1 to 7 depict the preferred embodiment of the instant invention which is generally referenced as a toilet-bidet and, or by numeric character 10. The instant invention provides a combined toilet-bidet system 10 that may be manufactured with a toilet 1 or mountable as a retrofit to an existing toilet 1. With reference to FIGS. 2-6, the toilet-bidet system 10 preferably comprises a toilet 1, at least one and preferably two adjustable nozzles 12 mounted to the toilet bowl 1 above the toilet water level 5, faucet/valve device or system 26 for receiving and controllably combining multiple water sources in a manner that controls the temperature of water outputted, first conduit 20 for delivering a hot water source to the faucet/valve system 26, second conduit 22 for delivering a cold water source to the faucet/valve system 26, splitter 28 fluidly and/or mechanically connected to the faucet/valve 26 to divide and output the combined water sources to the nozzles 12, nozzle conduit 27, 29 for delivering the water from the splitter 28 to the first and second nozzles 12, respectively, nozzle directional control system 34, 33 electrically and/or mechanically communicated with each nozzle 12 for controllably and independently adjusting the angle at which water is ejected from the nozzles 12, control panel 17 comprising the control system 26, 28, 30, 34 extending from the front of the toilet 1 and at least one channel 15 formed around the exterior of the upper toilet rim for concealing and routing conduit and lines 20, 22, 29, 32. In an alternative embodiment, the instant invention 10 may include an adapter 41 for connecting to any exhaust system 40-46 for removing odors from the toilet 1 and/or surrounding area, as shown in FIG. 7. The toilet-bidet system 10 preferably comprises a first adjustable nozzle 12 pivotably mounted to the front end of the toilet bowl 1 and second adjustable nozzle 12 pivotably mounted to the back end of the toilet bowl 1. To keep the nozzles 12 clean and away from contamination, the nozzles 12 are mounted above the water level 5 below the inside rim of the toilet bowl 1 so they have no contact with the water and waste in the bowl 1. The nozzles 12 are positioned below the rim so the water entering the bowl 1 when flushing cleans any residue and contamination that may be on the nozzles 12. The nozzle directional control system comprise a first nozzle control 34 electrically or mechanically coupled to the first nozzle 12 for adjusting it up and down, and a second nozzle control 33 mechanically coupled to the second nozzle 12 for adjusting it up and down. The hot and cold water lines 20, 22 extend from a common connector/adapter 24 to the faucet/valve 26. The channel 15 preferably conceals and routes the hot water conduit 20, the cold water conduit 22, the nozzle supply conduit 29 between the splitter 28 and rear nozzle 12, and, or the flush control line 32. The channel 15 may comprise the same material as the toilet 1, such as a ceramic-like material, or plastic-based material amenable for mass production and convenient installation. The channel 15 preferably extends around the toilet rim for symmetry and allowing the lines and conduit to be routed in either direction. The instant invention 10 may also include a control panel drainage 21 extending from the control panel 17 into the toilet bowl 1 for draining water that may leak inside the control panel 17. The control panel 17 is preferably waterproof.

Figure 4A:
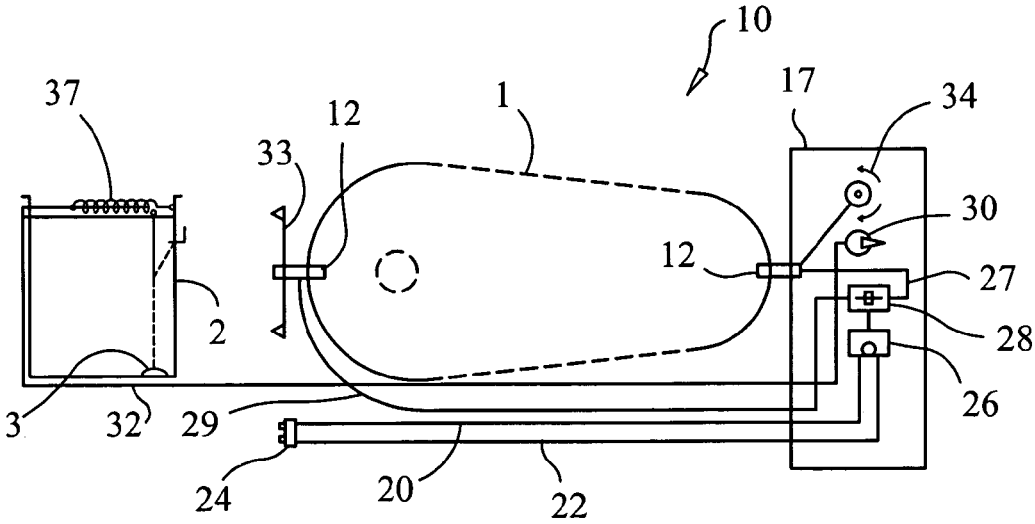
FIG. 4A is a system diagram view of the preferred embodiment of the toilet-bidet system in accordance with the instant invention.
Figure 4B:
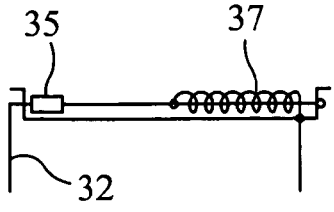
FIG. 4B is an illustrative view of the preferred electric flushing system of the toilet-bidet system in accordance with the instant invention.
Figure 5:
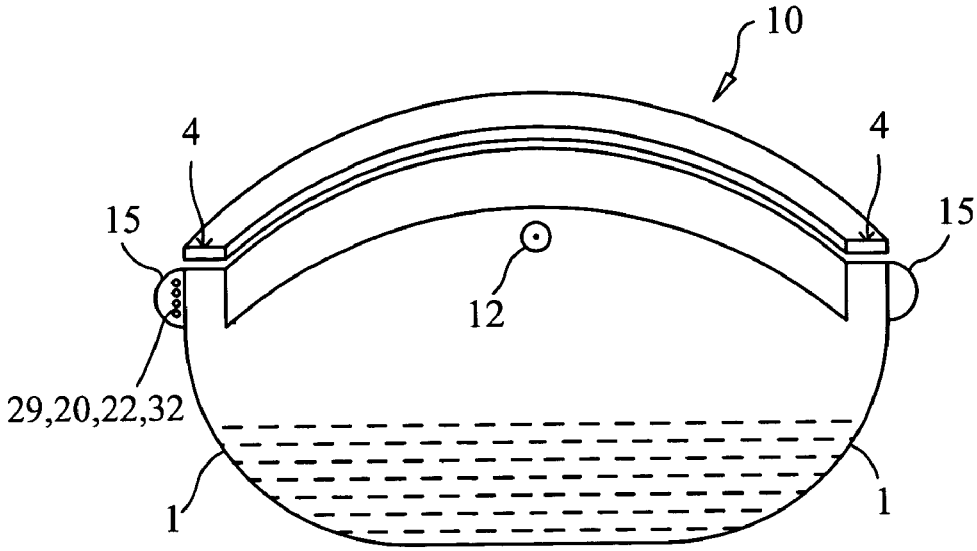
FIG. 5 is a partial cut-away view from a first side of the preferred embodiment of the toilet-bidet system in accordance with the instant invention.
Figure 6:
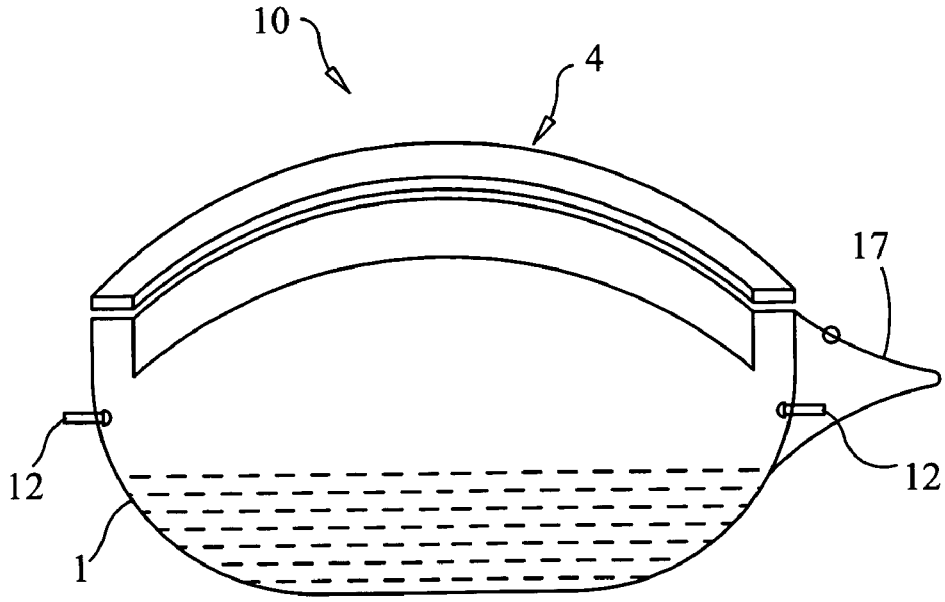
FIG. 6 is a partial cut-away view from a second side of the preferred embodiment of the toilet-bidet system in accordance with the instant invention.

With reference to FIGS. 4A and 4B, the preferred and alternative embodiments, the instant invention 10 may also include a flush/water-release control 30 and flush/water-release control line 32 for flushing a toilet 1 by actuating the release lever or plunger 3 in the toilet's water tank 2. The flush control line 32 comprises a line, cable or similar device connected to or otherwise in mechanical communication with a spring 37 and the plunger/valve 3. The flush control line 32 is mechanically actuated by the control 30 to open the plunger/valve 3, as shown in FIG. 4A. Alternatively, the instant invention 10 may include an electric solenoid 35, such as a 9 volt solenoid, electrically coupled to the flush control 30 by low voltage wiring and connected or otherwise in mechanical communication with the flush control line 32 and spring 37. The solenoid 35 is energized by actuating the flush control 30 and actuates the flush control line 32 when energized to open the plunger/valve 3. The plunger/valve 3 closes when the solenoid 35 is de-energized. In both embodiments, the spring 37 allows the plunger/valve 3 to close when the line 32 is released.

Figure 1:
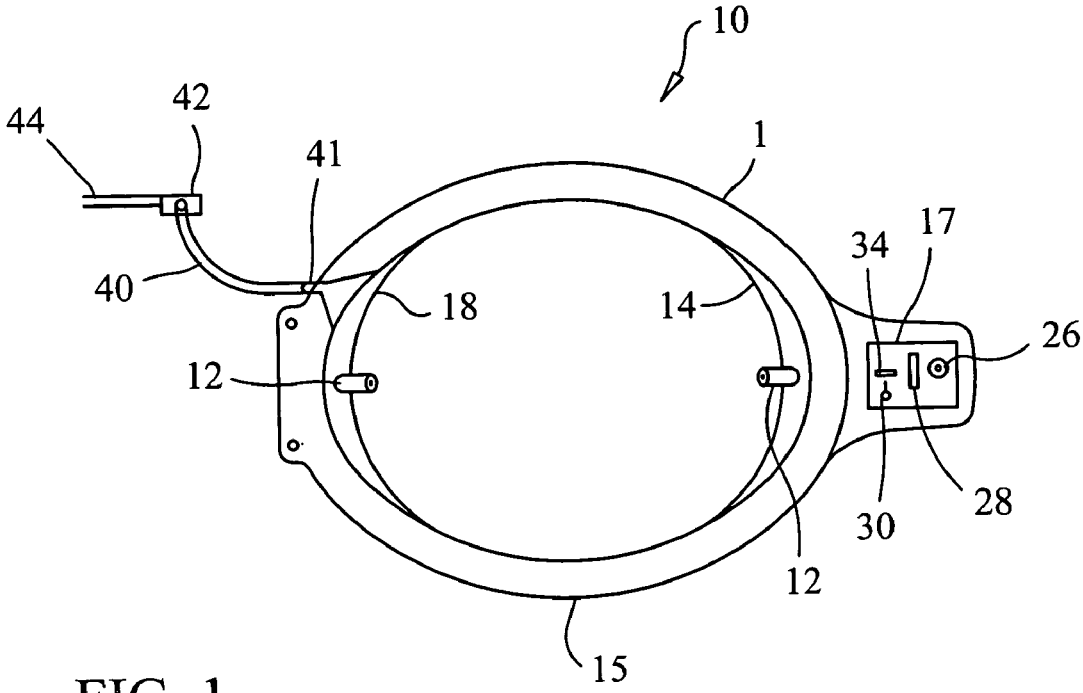
FIG. 1 is a plan view of a preferred embodiment of the toilet-bidet system as a retrofit designed for mounting to an existing toilet in accordance with the instant invention.
Figure 2:
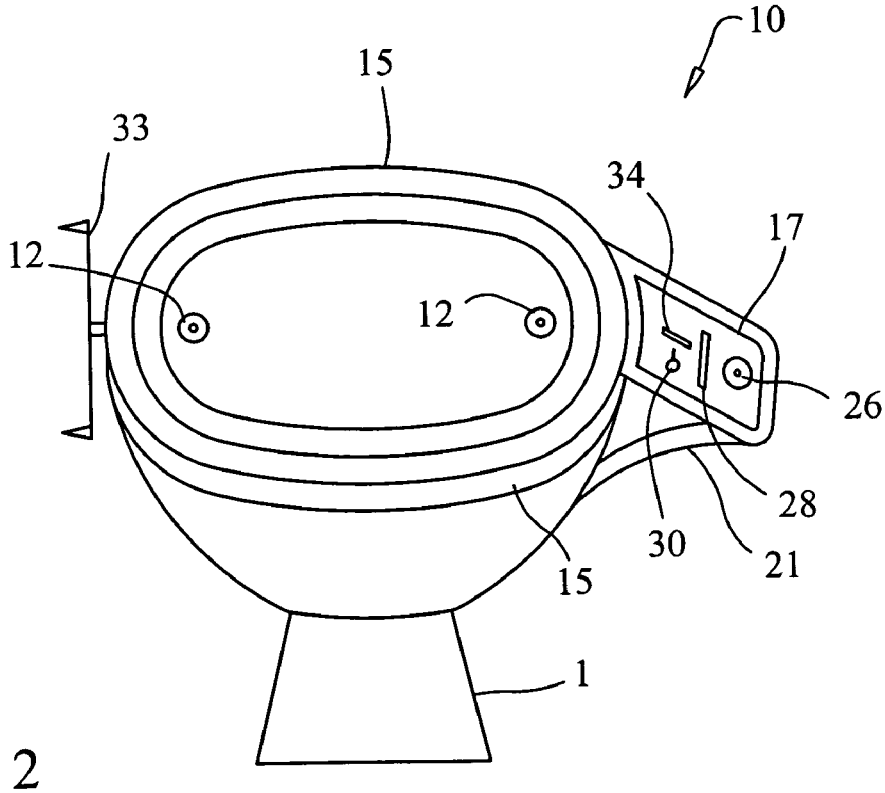
FIG. 2 is a perspective view of the preferred embodiment of the toilet-bidet system in accordance with the instant invention.
Figure 3:
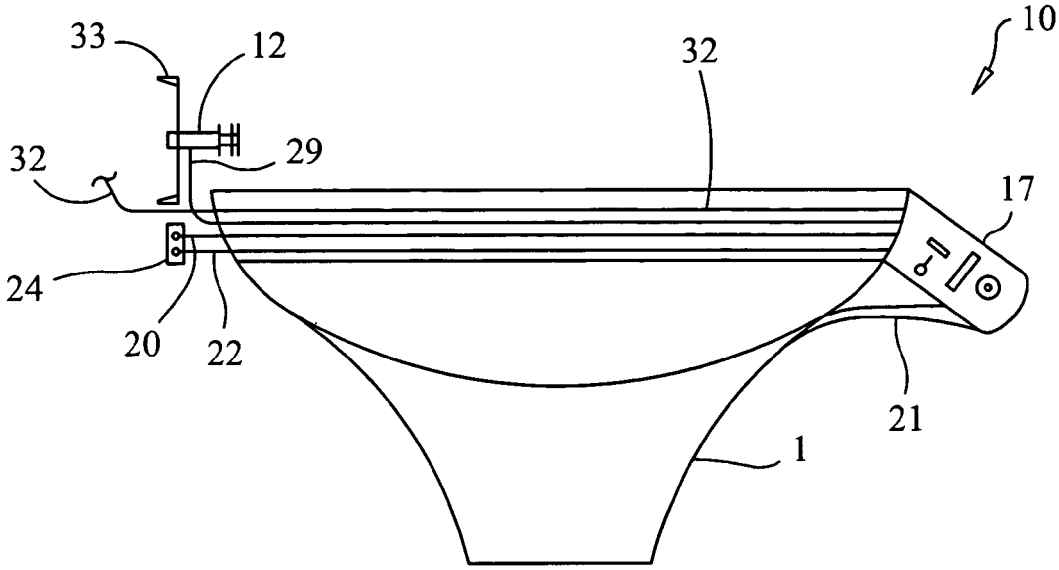
FIG. 3 is a partial cut-away illustrative view showing the general routing of the lines and conduit of the toilet-bidet system in accordance with the instant invention.

With reference to FIG. 1, the alternative embodiment of the instant invention 10 is designed as a retrofit for mounting to an existing toilet 1. The retrofitted toilet-bidet 10 comprises a first nozzle support mechanism 14 for securely mounting the first nozzle 12 to the front of an existing toilet 1, second nozzle support mechanism 18 for securely mounting the second nozzle 12 to the back end of the toilet 1, at least one channel 15 adapted for mounting to and, or around the rim of the toilet 1 below the seat 4 for concealing and routing the conduit and other lines 20, 22, 29, 32, and control system comprising the control panel 17, faucet/valve device 26, splitter 28, flush/water-release control 30 and structure for mounting the control panel 17 to the toilet 1. The first and second support mechanisms 14, 18 may comprise a bracket, clamp, harness or other support mechanism known in the art that are mountable to an existing toilet. The support mechanisms 14, 18 are positioned and concealed below the rim of the toilet 1 such that only the tips of the nozzles 12 are exposed. In this alternative embodiment, the nozzles 12 may be adjustable by hand to set the desired angle for ejecting water. The alternative embodiment preferably includes at least one of the flush control systems 30, 32, 35, 37 described herein. The alternative embodiment of the instant invention 10 may include an adapter 41 for connecting to any exhaust system 40-46 for removing odors from the toilet 1 and/or surrounding area, as shown in FIG. 7.

The control system 26, 28, 30, 34 is preferably secured and at least partially stored in the control panel 17 mounted or mountable to or near the front end of the toilet 1 to operate corresponding valves and mechanisms that release, combine and direct water. For instance, the faucet/valve system 26 includes a control switch in operable communication with a conventional valve that receives two sources of water from the hot and cold water conduits 20, 22 and adjustably combines and delivers the water to the splitter 28 at a selected temperature. The splitter 28 distributes water from the faucet/valve system 26 to the nozzles 12 and may comprise a T-like coupling or valve. The first nozzle control 34 causes the first nozzle 12 to move up and down. The flush/water-release control 30 is connected to or in mechanical communication with the flush control line 32, spring 37 and plunger 3. The control system 26, 28, 30, 34 is operably accessible from the control panel 17 and has tactile switches operably coupled to each control 26, 28, 30, 34, respectively. The control panel 17 is preferably positioned or mountable at or proximal the front end of the toilet 1. The control panel 17 preferably includes a water-tight seal that insulates it and its corresponding electronic circuitry from water and moisture. The valves and, or control system 26, 28, 30, 34 may comprise electronic, mechanical or fluid actuated controls. Power may be provided by DC batteries, such as 9-volt batteries, and/or AC power.

The hot and cold water conduit 20, 22 extend from the adapter 24 and facilitate the transfer of hot and cold water to the faucet/valve system 26. The faucet/valve system 26 receives and controls the mixture, amount and relative concentration of the received cold and hot water supplies to adjustably set the desired temperature of the water ejected from the nozzles 12. The faucet/valve system 26 is operated by a user from the control panel 17 to adjustably select the desired flow and temperature of water ejected from the nozzle(s) 12. The splitter 28 receives water outputted from the faucet/valve system 26 and directs it to the first and/or second nozzles 12. The splitter 28 can be set from the control panel 17 to provide water to one nozzle 12, both nozzles 12 or none of the nozzles 12. The flush/water-release control 30 is actuated to flush the toilet 1, is accessible from the control panel 17 and operates the toilet's 1 plunger/valve 3 via the flush line 32 and spring 37. The first nozzle directional control 34 is electronically and/or mechanically communicated with the front nozzle 12 for adjustably controlling the angle of the nozzle 12 to select the direction in which water is ejected from the nozzle 12. The second nozzle directional control 33 is preferably mechanically communicated with the rear nozzle 12 for adjustably controlling the angle of the nozzle 12 to select the direction in which water is ejected.

The preferred and alternative embodiments of the instant invention 10 may include an exhaust adapter port 41 for connecting an exterior exhaust conduit 40 that fluidly connects to any exhaust system 42, at least one exhaust line 44 and/or 45 and fan 46. The exterior exhaust conduit 40 fluidly connects at one end to the adapter 41 on the toilet 1 at a point selected for capturing and exhausting odors from the toilet 1 through the exhaust system 42-46 outdoors.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A combined toilet-bidet system for use with a toilet having a flushing mechanism, said system comprising:

a water source means for receiving a hot water source and cold water source;

a valve means, in fluid communication with said water source means, for receiving and selectively and adjustably controlling the resulting temperature of the water outputted by controlling the amount of the hot water source and cold water source outputted;

a first nozzle mountable proximal a front end of the toilet and a second nozzle mountable proximal a back end of the toilet, said first and second nozzles being in fluid communication with said valve means for receiving water outputted from said valve means and ejecting the water at least partially within the confines of the toilet;

nozzle adjustment means for adjusting the angle of said at least one nozzle, said first and second nozzles being in communication with said nozzle adjustment means;

a splitter means, in fluid communication with said valve means, said first nozzle and said second nozzle, for selectively directing water outputted from the valve means to said first nozzle and said second nozzle, said splitter means including a splitter control for dictating the delivery of water to said first and second nozzles;

a control panel mountable proximal the front end of the toilet, said control panel supporting and at least partially concealing said valve means, said splitter control and said nozzle adjustment means; and exhaust means, in mechanical communication with the toilet, for exhausting odors from and around the toilet outside.

2. A system as recited in claim 1, wherein said control panel comprises a water-tight-seal.

3. A system as recited in claim 1, further comprising:

flush means, in communication with the toilet's flushing mechanism, for flushing the toilet, said flush means include a flush control supported and at least partially concealed by said control panel.

4. A system as recited in claim 3, further comprising:

conduit for fluidly communicating said water source means with said valve means, said valve means with said splitter means, said splitter means with said nozzles and said exhaust means with the toilet.

5. A system as recited in claim 4, further comprising:

a channel for routing and at least partially concealing said conduit and said flush means around at least a portion of the toilet.

6. A system as recited in claim 4, further comprising:

a channel on the toilet for routing and at least partially concealing said conduit and said flush means.

7. A system as recited in claim 6, wherein said flush means is electrically operated and comprises wire routed through said channel to the flushing mechanism.

8. A system as recited in claim 6, wherein said flush means is mechanically operated and comprises a cable routed through said channel to said flushing mechanism.

9. A system as recited in claim 1, further comprising:

means for mounting said first and second nozzles to the toilet.

* * * * *